US005753849A

United States Patent [19]

Posey et al.

[11] Patent Number: 5,753,849

[45] Date of Patent: May 19, 1998

[54] GAS-OPERATED TIMING DEMOLITION DELAY

[75] Inventors: B. Kelley Posey, Glen Carbon; Bradley Q. Niemann, Hillsboro; M. Russel Phinney, Collinsville, all of Ill.

[73] Assignee: Propellex Corporation, Edwardsville, Ill.

[21] Appl. No.: 724,302

[22] Filed: Sep. 19, 1996

[51] Int. Cl.[6] ..... F42C 15/32

[52] U.S. Cl. ..... 102/223

[58] Field of Search ..... 102/223, 224, 102/228, 230, 275.11

[56] References Cited

U.S. PATENT DOCUMENTS

| | | | |
|---|---|---|---|
| 3,430,568 | 3/1969 | Amster . | |
| 3,630,150 | 12/1971 | Rakowsky | 102/224 |
| 3,630,151 | 12/1971 | Rakowsky | 102/224 |
| 3,714,863 | 2/1973 | Sindall | 102/223 |
| 3,714,899 | 2/1973 | Filippi | 102/356 |
| 3,766,733 | 10/1973 | Drzewiecki et al. . | |
| 3,944,249 | 3/1976 | Smith et al. | 102/360 |
| 3,994,231 | 11/1976 | Rudeen et al. | 102/224 |
| 4,188,886 | 2/1980 | Brauer et al. | 102/223 |
| 4,326,461 | 4/1982 | Toms . | |
| 4,328,754 | 5/1982 | Goodman . | |
| 4,395,951 | 8/1983 | Hinely et al. | 102/223 |
| 4,643,096 | 2/1987 | Durrell et al. | 102/228 |
| 4,836,109 | 6/1989 | Wesson et al. | 102/312 |
| 4,865,009 | 9/1989 | Ford et al. | 124/76 |
| 5,280,778 | 1/1994 | Kotsiopoulos | 124/73 |
| 5,339,876 | 8/1994 | Mattern | 124/56 |
| 5,615,912 | 4/1997 | O'Loughlin et al. | 280/737 |

*Primary Examiner*—Michael J. Carone
*Assistant Examiner*—Theresa M. Wesson
*Attorney, Agent, or Firm*—Kalish & Gilster

[57] ABSTRACT

Time delay apparatus for providing a firing action at the end of a predetermined time-delay period. It is used with a source of fluid under pressure, and defines a fluid-receiving chamber for accumulating the fluid when released from the source. A flow controller is connected between the source and the fluid-receiving chamber for providing fluid communication between the source and the fluid-receiving chamber. A triggering assembly initiates flow of fluid from the source through the flow controller and into the fluid-receiving chamber. A piston-form firing pin in the fluid-receiving chamber is actuated by shear pin release for movement to an actuating position for desired firing action when a predetermined pressure has accumulated in the fluid-receiving chamber at the end of the predetermined time-delay period.

9 Claims, 1 Drawing Sheet

GAS-OPERATED TIMING DEMOLITION DELAY

BACKGROUND OF THE INVENTION

This invention relates to a time delay apparatus and, more particularly, to a simple and economical time delay apparatus for providing a firing action at the end of a predetermined time-delay period.

The invention is particularly concerned with providing a precisely predetermined period of time for detonation of a charge, as for demolition. The invention is capable of providing precisely predetermined time delays of several seconds, minutes or hours.

Existing time delay devices have typically been either electrical, mechanical or chemical in nature. Electrical devices, while reasonably reliable, are relatively expensive and sensitive. Mechanical devices are usually complex and heavy. Chemical devices are oftentimes bulky and unreliable.

In the patent literature are to be found various delay arrangements, such as the delay actuator of Amster U.S. Pat. No. 3,430,568 suitable for grenade detonation, and incorporating a cylinder in which a piston is held in a latched position but then moves with delayed action governed by the escape of air until striking a firing piston.

In Goodman U.S. Pat. No. 4,328,754 a time delay device also uses a piston cooperating with a firing device, the piston being permitted to move in a fluid reservoir at a speed, causing a delayed action, controlled the viscosity of the fluid.

In the time delay device of Toms U.S. Pat. No. 4,326,461, a piston similarly is permitted to move under fluid pressure at a selected rate, providing a time delay, until it moves to a detonation-effecting position.

Such arrangements using pistons have the inherent disadvantage that any mechanical imperfection of the piston or its chamber can contribute to error in the delayed movement, or even impede movement, of the piston. Thus, reliability is dependent upon achieving a high degree of precision in the design.

A fluidic time delay, providing extended duration for actuating an ordnance device, is also proposed by Drzewiecki et al U.S. Pat. No. 3,766,733, but the arrangement requires both a pressurized gas and a highly viscous liquid, and lacks capability for field use where the time delay desired could be easily and reliably set. Moreover, this latter arrangement does not provide a construction useful with a wide variety of possible ordnance detonators, nor does it lend itself to use with a wide variety of possible actuators.

SUMMARY OF THE INVENTION

Accordingly, among the several objects and advantages of the present invention are the provision of a improved high-precision delay detonator

- which is of low cost, low weight and low complexity;
- which is compact, rugged and simple to operate, being only easy to use and capable;
- which is capable of providing a wide range of delay actions which are easily predetermined or set;
- which is modular in configuration;
- which is capable of being used with a wide variety of possible ordnance detonators and a wide variety of possible actuators;
- which does not rely on a piston for time-delay effect;

- which uses a single fluid for both actuation and delay effect;
- which is inherently shock-resistant and durable for assured transport and field use;
- which is easy to manufacture; and
- which is remarkably simple in configuration.

Briefly, a time delay apparatus for provides a firing action at the end of a predetermined time-delay period. It comprises means for providing a source of fluid under pressure, a fluid-receiving chamber defined by the time delay apparatus for accumulating the fluid when released from the source, and a flow controller connected between the source and the fluid-receiving chamber for providing fluid communication between the source and the fluid-receiving chamber. It further comprises means for initiating the flow of fluid from the source through the flow controller and into the fluid-receiving chamber, and a pressure-responsive actuator in communication with the fluid-receiving chamber for being actuated when a predetermined pressure has accumulated in the fluid-receiving chamber at the end of the predetermined time-delay period.

Other objects, advantages and features will be apparent or are pointed out in the following description.

DETAILED DESCRIPTION OF PRACTICAL EMBODIMENT

Figure 1:
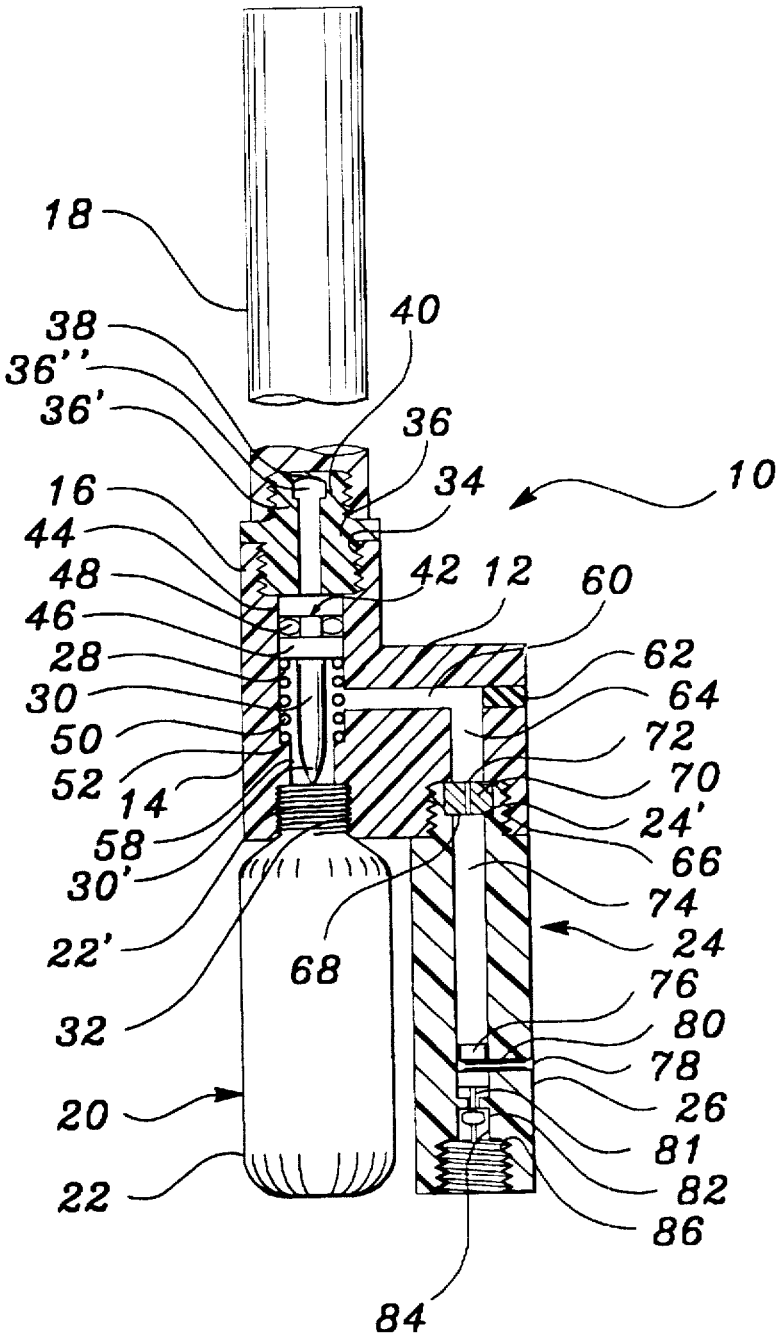
FIG. 1 is a longitudinal cross-sectional view of relevant portions of the time delay detonator apparatus in accordance with and embodying the present invention.

Referring to the accompanying drawing in which like reference numbers indicate like elements, FIG. 1 illustrates generally at 10 a time delay apparatus, namely a delay detonator of the type which may be used for delay detonation of munitions, propellants, and other combustible materials, as for example for building demolition and for myriad purposes well-known in military applications.

Apparatus 10 comprises a central body 12 of suitable machined metal, e.g., an alloy such as brass or stainless steel. Body 12 has a base portion 14 and an upper, valve-containing portion 16 to which fitted a so-called MK55 firing device 18, the purpose of which will become clear. Coaxial with firing device 16 and portion 18 is a gas source generally designated 20 in the form of liquified carbon dioxide contained within a cylindric pressure vessel 22 fitted to base portion 14.

Extending in parallel relation to pressure vessel 22 is a delay assembly generally designated 24 including a cylindric detonation body 26 similarly fitted to body base portion 14 for purposes presently appearing.

Firing device 18 is illustrative of any of a variety of possible actuating mechanisms which may be interengaged with apparatus 10 for initiating its operation and does not by itself constitute an essential component of a gas-operated timing demolition delay of the invention, being typical of a means for initiating a delay action in which there is flow of fluid from pressure source 22 through a flow controller mechanism of apparatus 10 for purposes presently appearing.

Specifically provided within a chamber 28 is a piercing pin 30 having a pointed end 30' oriented for being driven into a conventional seal of cylinder 22, which may be a standard carbon dioxide cartridge of the type commercially available for powering or inflating other devices. Thus, a neck 22' of the cylinder is threaded into a corresponding bore 32 of body 12, and so it will be understood that cylinder 22 is not only replaceable but for safety reasons may be fitted in place only prior to use of apparatus 10.

Similarly, a threaded bore 34 is provided within upper body portion 16 for receiving a threaded nipple 36' of an adapter 36 for mating apparatus 10 to firing device 18 by threading the latter on an upper nipple 36" of the adapter, which nipple receives a available percussion primer 38 of suitable type fitted within a recess 40 which communicates through a passage to the upper end of chamber 28, in which there is provided a valve spool assembly generally 42 having upper and lower flanges 44,46 which define between them space for an O-ring seal 48. A coil compression spring 50 coaxial with piercing pin 30 bears against lower flange 46 and a shoulder 52 for biasing spool assembly 52 upwardly within chamber 28 to prevent piercing pin 46 from piercing cylinder 22 unless driven toward the cylinder by detonation of primer 38.

Primer 38 is intended to be ignited by action of firing device 18; and yet many other arrangements for igniting primer 38, such as spring-loaded hammer or trip or trigger mechanism, are possible.

Extending toward cylinder 22 downwardly from shoulder 52 is a narrowed chamber 58 portion having an insider diameter sized for freely permitting gas flow from cylinder 22 coaxially about piercing pin 46 into chamber 28.

Opening laterally from chamber 28 within housing 12 is a passage 60 closed by a plug 62 at its chamber-remote end; and in turn communicating with a vertical passage 64 which terminates in a threaded recess 66 in which delay assembly 24 is fitted.

Delay assembly 24 is a self-contained apparatus appropriate for preselecting a precise time delay interval for delay operation of time delay apparatus 10. For this purpose, assembly 24 has a threaded extension 24' which is screwed into recess 66 and which carries in a shallow recess 68 at its uppermost portion an orifice disk 70 in which a precisely dimensioned orifice 72 is provided at the center as a through-hole opening between passage 64 and a corresponding extension passage 74 extending axially though a principal portion of the length of delay assembly 24. Closing a lower portion of passage 74 is a firing pin 76 in the form of a cylindrical piston of suitable material, e.g., metal alloy such as brass, which is pinned in place by a shear pin 78 inserted through a lateral opening 80 bored into the side wall of delay assembly 24. Firing pin 76 carries at its lower end a firing pin tip 81 spaced in close proximity to a suitable available type of percussion primer assembly 82 which is fitted into a recess 84 at the upper end of a threaded recess 86 by which the entire time delay apparatus 10 may be secured to any of myriad possible devices to be detonated, such as engineering explosive packages, grenade-like devices, munitions, charges or other ignitable substances.

In use, orifice disk 70 is selected (and may already be provided in a selected delay unit 24 marked for appropriate delay interval) to establish the desired firing delay interval. The units 12, 18, 20 and 24 are mated together as shown and suitable triggering or firing means is connected to device 18.

In operation of time delay apparatus 10, firing device 18 is conventionally fired. The discharge of device 18 against percussion primer 38 releases combustion gases which drive piston flange 44 downwardly for corresponding piercing of gas cylinder 20. As carbon dioxide is released from cylinder 20, it flows from chamber 28 through passages 60 and 64 and accordingly into orifice 72. After a time delay precisely determined by orifice 72, pressure is built up in passage 74 to a predetermined value sufficient for causing firing pin 76 to shear the shear pin 78 which keeps it in place until the moment of actuation. Firing pin tip 81 now contacts percussion primer 82 for carrying out desired firing action. Thus it is seen that piston 76 is maintained in a secured first position by shear pin 78 as a releasable element; and is displaced from the first position to an actuating second position at the end of the time delay period by pressure build-up in the fluid-receiving chamber constituted by passage 74.

As will be apparent, the various elements of time delay apparatus 10 are modular. Thus, they may be varied and selected from various types which may be effective. Device 18 is but one form of possible firing device, for example; and gas cylinder 20 may be replaced by another source of pressure. Also, for safety purposes, the modules need not be assembled for their intended delayed-action firing purpose until shortly before use.

In view of the foregoing, it will be seen that the several objects of the invention are achieved and other advantages are attained.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. A time delay apparatus for providing a firing action at the end of a predetermined time-delay period, comprising:

means for providing a source of fluid under pressure;

a fluid-receiving chamber contained by the time delay apparatus for accumulating the fluid when released from the source;

a flow controller connected between the source and the fluid-receiving chamber for providing fluid communication between the source and the fluid-receiving chamber;

means for initiating the flow of fluid from the source through the flow controller and into the fluid-receiving chamber, comprising a valve assembly including a piercing element for piercing the source for releasing the fluid for flow through the communication upon triggering of the means for initiating the flow of fluid from the source; and a pressure-responsive actuator in communication with the fluid-receiving chamber for being actuated when a predetermined pressure has built up in the fluid-receiving chamber at the end of the predetermined time-delay period.

2. A time delay apparatus according to claim 1, wherein the fluid is gas and the source is a gas cylinder for providing the gas under pressure.

3. A time delay apparatus according to claim 1, wherein the source is removably connected to the apparatus.

4. A time delay apparatus according to claim 1, wherein the flow controller is precalibrated to provide a preselected rate of flow for permitting a flow of fluid from the source into the fluid-receiving chamber over a predetermined period of time.

5. Time delay apparatus according to claim 1 further comprising a triggering percussion primer for driving the piercing element for piercing the source.

6. A time delay apparatus according to claim 1, wherein the pressure-responsive actuator comprises a firing pin.

7. Time delay apparatus according to claim 1 wherein the pressure responsive actuator is in the form of a piston maintained in a first position by a releasable element and is displaced from the first position to an actuating second position at the end of the time delay period by pressure build-up in the fluid-receiving chamber.

8. Time delay apparatus according to claim 7 wherein the releasable element is a shear pin.

9. Time delay apparatus according to claim 8 wherein the pressure-responsive actuator further comprises an actuating percussion primer for being fired by movement of the pressure responsive actuator to the actuating second position, for carrying out desired firing action.

* * * * *